US008245680B2

(12) United States Patent
Nguyen

(10) Patent No.: US 8,245,680 B2
(45) Date of Patent: Aug. 21, 2012

(54) ENGINE INCLUDING VALVE LIFT MECHANISM WITH STRESS REDUCTION FEATURES

(75) Inventor: Hong Wai Nguyen, Troy, MI (US)

(73) Assignee: GM Global Technology Operations LLC

( * ) Notice: Subject to any disclaimer, the term of this patent is extended or adjusted under 35 U.S.C. 154(b) by 385 days.

(21) Appl. No.: 12/716,795

(22) Filed: Mar. 3, 2010

(65) Prior Publication Data

US 2011/0214635 A1 Sep. 8, 2011

(51) Int. Cl.
*F01L 1/18* (2006.01)

(52) U.S. Cl. ..... 123/90.39; 123/90.44; 29/888.2; 74/559

(58) Field of Classification Search ..... 123/90.39, 123/90.44; 29/888.2; 74/559, 567, 569
See application file for complete search history.

(56) References Cited

U.S. PATENT DOCUMENTS 7,918,201 B2 * 4/2011 Yoshihara et al. ..... 123/90.39

* cited by examiner

*Primary Examiner* — Ching Chang
(74) *Attorney, Agent, or Firm* — Harness, Dickey & Pierce, P.L.C.

(57) ABSTRACT

An engine assembly may include an engine structure supporting a camshaft and a valve lift mechanism. The camshaft may include a cam lobe and may define a longitudinally extending rotational axis. The valve lift mechanism may define a longitudinally extending cam engagement surface and a first side wall. The cam engagement surface may be engaged with the cam lobe at a first location. The first side wall may be fixed to the cam engagement surface and may include first and second portions. The first portion may extend from the cam engagement surface. The second portion may extend continuously inward from an end of the first portion. The inward extent of the second portion may be greater than or equal to a first height at the first location defined from the cam engagement surface to the end of the first portion.

20 Claims, 4 Drawing Sheets

ENGINE INCLUDING VALVE LIFT MECHANISM WITH STRESS REDUCTION FEATURES

FIELD

The present disclosure relates to stress reduction features in engine valve lift mechanisms.

BACKGROUND

This section provides background information related to the present disclosure which is not necessarily prior art.

Engine assemblies may include valve lift mechanisms engaged with camshaft lobes for actuation of intake and exhaust valves. During valve lift events a load is applied on the valve lift mechanisms and cam lobes as a result of the engagement therebetween. The engagement between the valve lift mechanisms and lobes may result in stress concentration at edge regions thereof.

SUMMARY

An engine assembly may include an engine structure, a camshaft and a valve lift mechanism. The camshaft may include a cam lobe and may be rotationally supported on the engine structure defining a longitudinally extending rotational axis. The valve lift mechanism may be supported on the engine structure and may define a body including a longitudinally extending cam engagement surface and a first side wall.

The longitudinally extending cam engagement surface may be engaged with the cam lobe at a first location and may define first and second longitudinal end regions opposite one another. The first side wall may be fixed to the cam engagement surface and may include first and second portions. The first portion may extend from the cam engagement surface. The second portion may extend continuously inward from an end of the first portion toward the second longitudinal end region. The inward extent of the second portion may be greater than or equal to a first height at the first location defined from the cam engagement surface to the end of the first portion.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Figure 1:
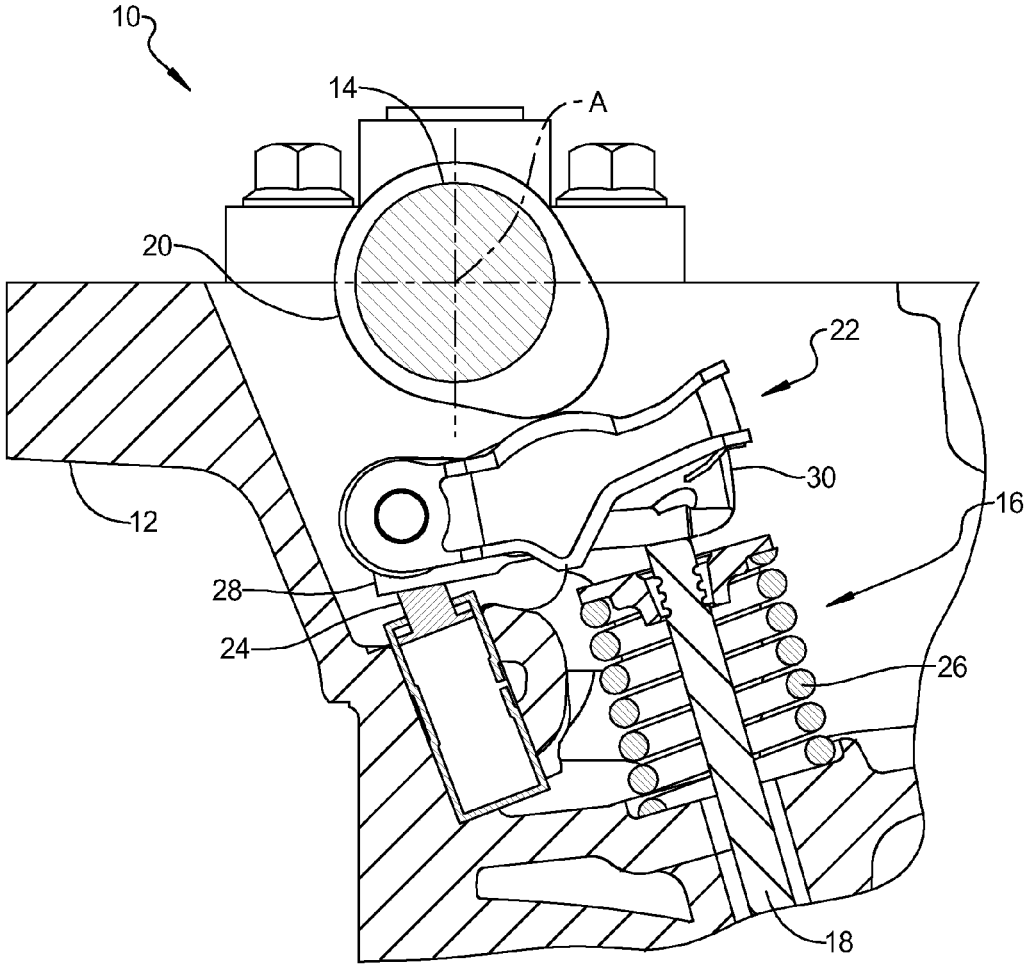
FIG. 1 is a fragmentary section view of an engine assembly according to the present disclosure.

With reference to FIG. 1, an engine assembly 10 is illustrated. The engine assembly 10 may include an engine structure 12, a camshaft 14 rotationally supported on the engine structure 12, a valve lift assembly 16 and a valve 18. In the present non-limiting example, the engine assembly 10 is shown as an overhead camshaft engine. However, the present disclosure is not limited to overhead camshaft arrangements and applies equally to cam-in-block arrangements. It is further understood that the present disclosure applies equally to intake and exhaust valve lift assemblies.

In the present non-limiting example, the engine structure 12 may include a cylinder head. The camshaft 14 may include cam lobes 20 (one shown) and may define a longitudinally extending rotational axis (A). The valve lift assembly 16 may include a valve lift mechanism 22, a lash adjustor 24 and a valve spring 26. By way of non-limiting example, the valve lift mechanism 22 may form a rocker arm including a first lateral end 28 supported for pivotal displacement by the engine structure and a second lateral end 30 engaged with the valve 18. However, it is understood that the present disclosure is not limited to rocker arms.

The lash adjuster 24 may support the first lateral end 28 of the valve lift mechanism 22. The valve spring 26 may be engaged with the engine structure 12 and may bias the valve 18 into engagement with the valve lift mechanism 22 and to a closed position. With additional reference to FIG. 2, the valve lift mechanism 22 may form a multi-step rocker arm including an outer arm 32 and an inner arm 34. The outer arm 32 may include first and second portions 36, 38, each defining a longitudinally extending cam engagement surface 40, 42, and the inner arm 34 may include a roller member 44. The first and second portions 36, 38 of the outer arm 32 may be similar to one another. Therefore, for simplicity, the first portion 36 will be described with the understanding that the description applies equally to the second portion 38.

The valve lift mechanism 22 may be operable in a first mode where the outer arm 32 is displaceable relative to the inner arm 34 and a second mode where the outer arm 32 is fixed for displacement with the inner arm 34. However, the present disclosure is not limited to such arrangements and applies equally to a variety of other valve lift arrangements including, but not limited to, single arm lift mechanisms.

Figure 2:
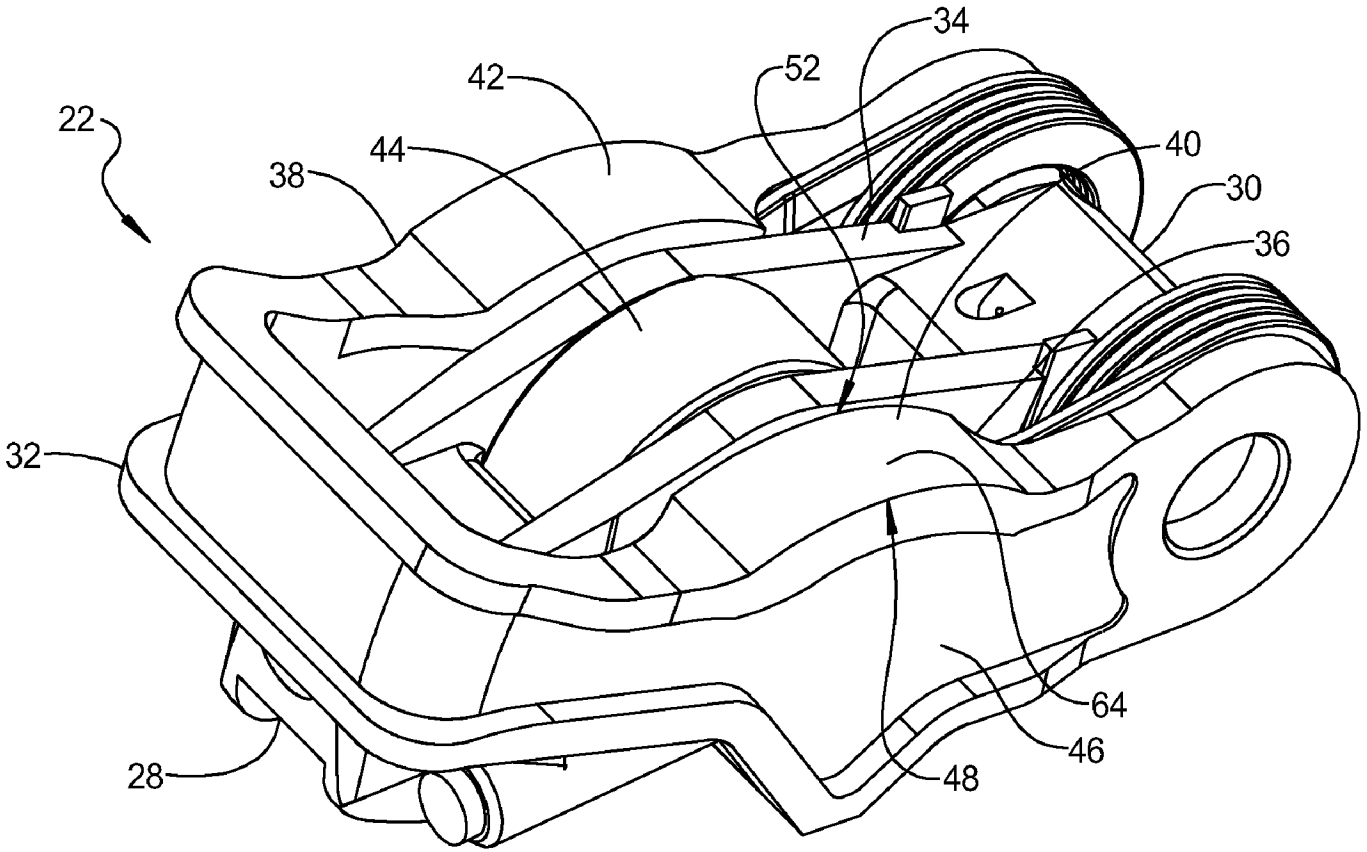
FIG. 2 is a perspective view of a valve lift mechanism of the engine assembly of FIG. 1.
Figure 3:
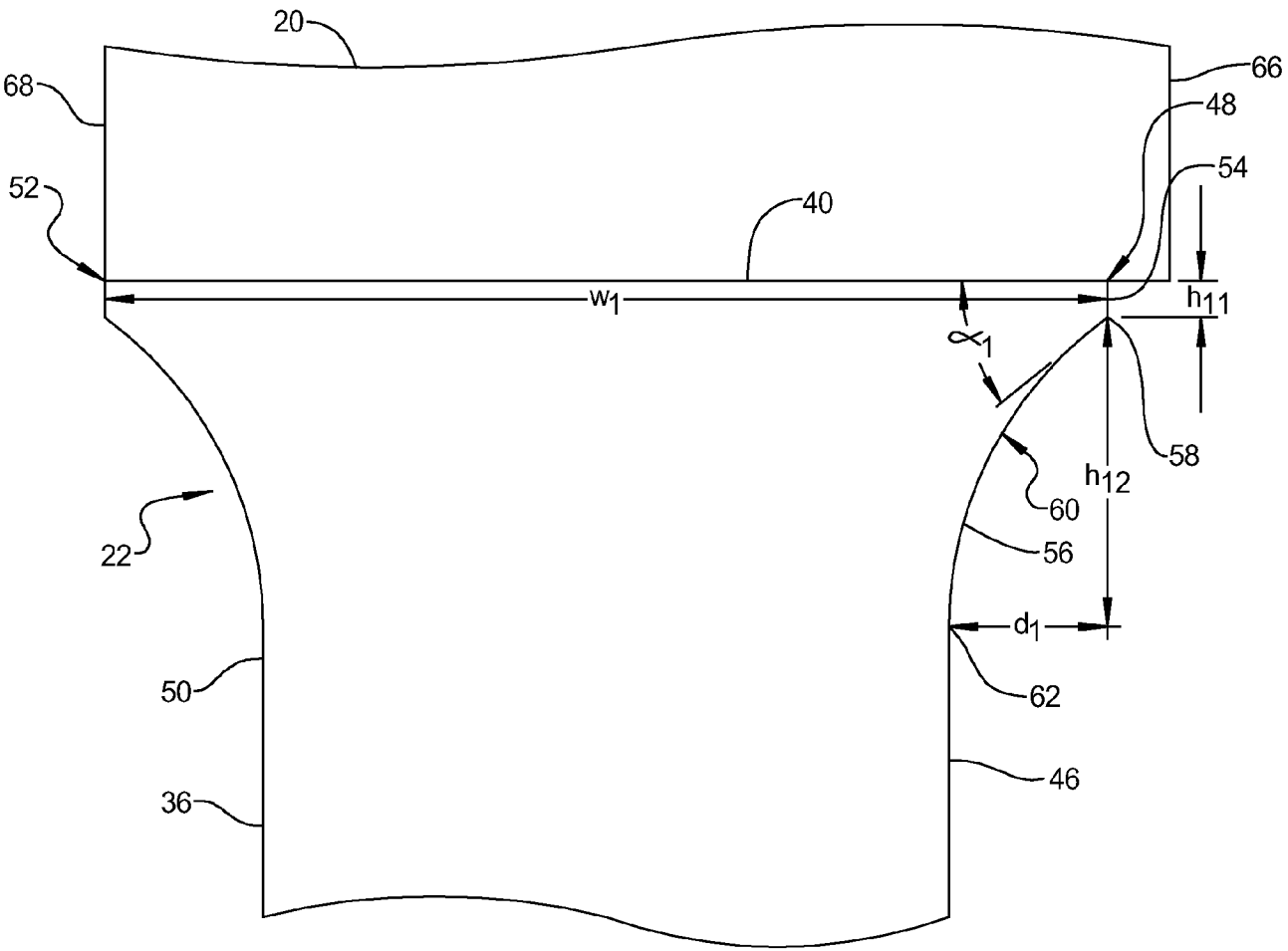
FIG. 3 is a schematic illustration of a portion of the valve lift mechanism shown in FIG. 2.

With reference to FIGS. 2 and 3, the first portion 36 of the valve lift mechanism 22 may include a first sidewall 46 extending from a first longitudinal end region 48 of the cam engagement surface 40 and a second sidewall 50 extending from a second longitudinal end region 52 of the cam engagement surface 40 opposite the first longitudinal end region 48. The first portion 36 may form a monolithic body including the cam engagement surface 40 and the first and second sidewalls 46, 50. Therefore, the cam engagement surface 40 may form a slider pad fixed for rotation with the first and second sidewalls 46, 50.

The first and second sidewalls 46, 50 may define a height of the first portion 36 of the valve lift mechanism 22. The first and second sidewalls 46, 50 may be generally similar to one another. Therefore, the first sidewall 46 will be described with the understanding that the description applies equally to the second sidewall 50. The first sidewall 46 may include a first portion 54 extending from the cam engagement surface 40 and a second portion 56 extending from an end 58 of the first portion 54.

The second portion 56 may extend continuously inward from the first portion 54 in a longitudinal direction from the first longitudinal end region 48 toward the second longitudinal end region 52. In the present non-limiting example, the second portion 56 may form a recess 60 in the first sidewall 46 defining a curved surface. However, it is understood that the second portion 56 may alternatively extend linearly from the first portion 54. By way of non-limiting example, the second portion 56 may extend at an angle ($\alpha_1$) of ten to eighty degrees relative to the cam engagement surface 40 at an interface between the first and second portions 54, 56 defined at the end 58 of the first portion 54.

The second portion 56 may include an end 62 defining a maximum depth ($d_1$). The depth ($d_1$) may be the maximum continuously inward extent from the end 58 of the first portion 54. It is understood that the depth ($d_1$) may remain constant, decrease or increase after the end 62 of the second portion 56. In present non-limiting example, the end 58 is illustrated longitudinally aligned with the terminal end of the first longitudinal end region 48 of the cam engagement surface 40. However, it is understood that alternate arrangements may exist where the end 58 is located longitudinally inward or outward from the terminal end of the first longitudinal end region 48.

The first portion 54 may define a height ($h_{11}$) from the cam engagement surface 40 to the end 58. The height ($h_{11}$) may define a minimum thickness region of the first portion 36 of the valve lift mechanism 22 along the cam engagement surface 40. By way of non-limiting example, the height ($h_{11}$) may be less than forty percent of the longitudinal extent, or width, ($w_1$) of the cam engagement surface 40. The depth ($d_1$) of the second portion 56 may be greater than or equal to the height ($h_{11}$). The depth ($d_1$) may be less than the longitudinal extent, or width, ($w_1$) of the cam engagement surface 40. The height ($h_{12}$) of the second portion 56 may continuously increase from the end 58 of the first portion 54 to the end 62 of the second portion 56. The height ($h_{12}$) may be greater than the height ($h_{11}$).

In the present non-limiting example, the cam engagement surface 40 defines a curved profile along its lateral extent. The height ($h_{11}$) at the end 58 and the depth ($d_1$) may be defined at a peak 64 (FIG. 2) of the curved profile of the cam engagement surface 40. The height ($h_{11}$) may be defined generally perpendicular to the cam engagement surface 40. More specifically, and by way of non-limiting example, the height ($h_{11}$) at the end 58 and the depth ($d_1$) may be defined along a majority of the curved profile of the cam engagement surface 40. The lateral extent of the cam engagement surface 40 engaged with the cam lobe 20 may include the height ($h_{11}$) at the end 58 and the depth ($d_1$) along the lateral extent.

As illustrated in FIG. 3, the cam lobe 20 may include first and second longitudinal ends 66, 68 forming edges. The first longitudinal end region 48 may be located longitudinally between the first and second longitudinal ends 66, 68 of the cam lobe 20. The structure defined by the second portion 56 of the first sidewall 46 discussed above may generally reduce contact stress on the valve lift mechanism 22. As indicated above, it is understood that the features of the first portion 36 of the valve lift mechanism 22 may be incorporated into a valve lift mechanism having a single arm.

Figure 4:
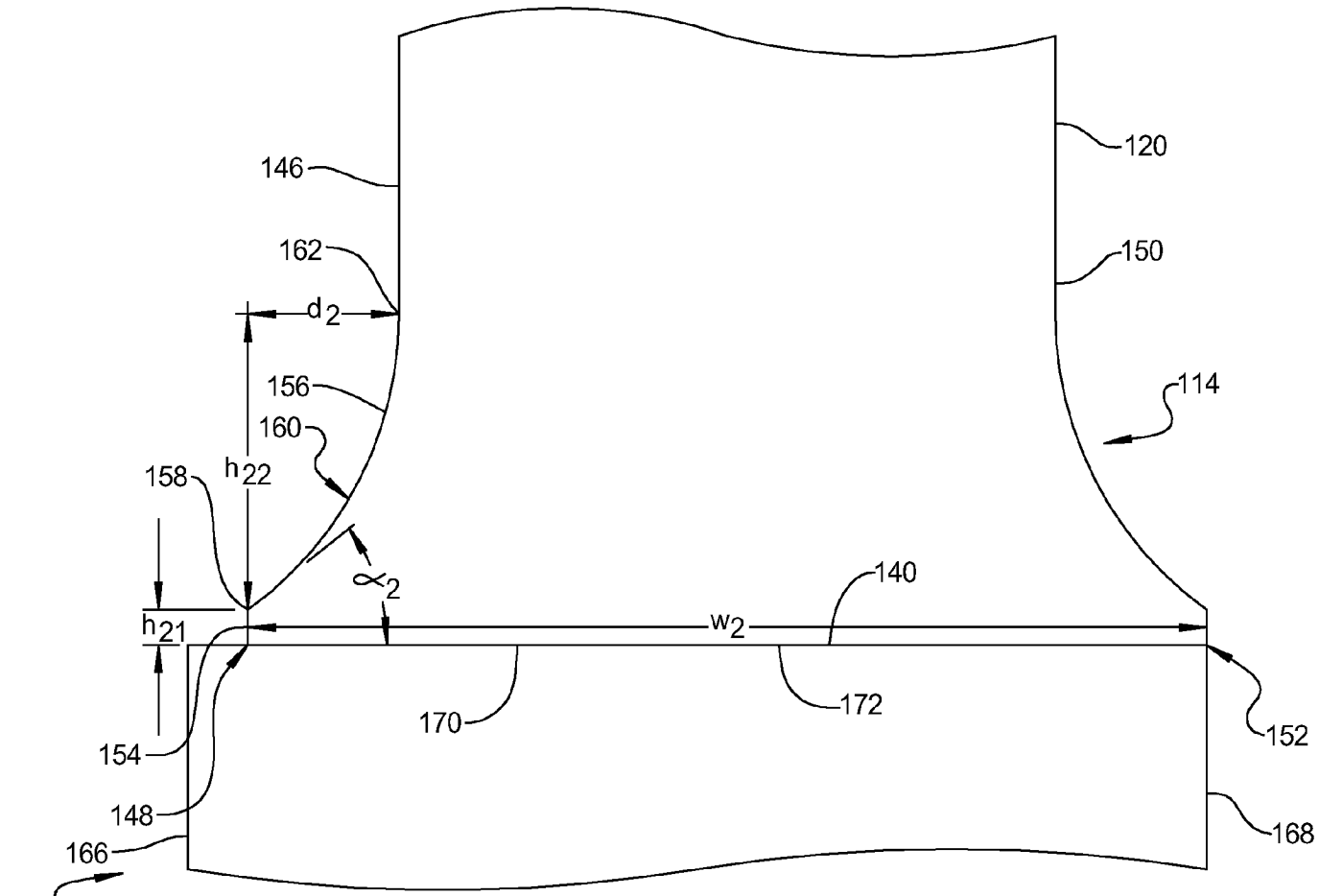
FIG. 4 is a schematic illustration of a cam lobe including the features of the present disclosure.

Alternatively, and with reference to FIG. 4, the features of the first and second portions 54, 56 of the valve lift mechanism 22 described above may be incorporated into a cam lobe 120 of a camshaft 114. The cam lobe 120 may include a peak 170 defining an outer circumferential surface 172. The cam lobe 120 may include a first sidewall 146 extending from a first longitudinal end region 148 of the surface 172 and a second sidewall 150 extending from a second longitudinal end region 152 of the surface 172 opposite the first longitudinal end region 148.

The first and second sidewalls 146, 150 may define a height of the peak 170 relative to the base circle region of the cam lobe 120. The first and second sidewalls 146, 150 may be generally similar to one another. Therefore, the first sidewall 146 will be described with the understanding that the description applies equally to the second sidewall 150. The first sidewall 146 may include a first portion 154 extending from the surface 172 and a second portion 156 extending from an end 158 of the first portion 154.

The second portion 156 may extend continuously inward from the first portion 154 in a longitudinal direction from the first longitudinal end region 148 toward the second longitudinal end region 152. In the present non-limiting example, the second portion 156 may form a recess 160 in the first sidewall 146 defining a curved surface. However, it is understood that the second portion 156 may alternatively extend linearly from the first portion 154. By way of non-limiting example, the second portion 156 may extend at an angle ($\alpha_2$) of ten to eighty degrees relative to the surface 172 at an interface between the first and second portions 154, 156 defined at the end 158 of the first portion 154.

The second portion 156 may include an end 162 defining a maximum depth ($d_2$). The depth ($d_2$) may be the maximum continuously inward extent from the end 158 of the first portion 154. It is understood that the depth ($d_2$) may remain constant, decrease or increase after the end 162 of the second portion 156. In present non-limiting example, the end 158 is illustrated longitudinally aligned with the terminal end of the first longitudinal end region 148 of the surface 172. However, it is understood that alternate arrangements may exist where the end 158 is located longitudinally inward or outward from the terminal end of the first longitudinal end region 148.

The first portion 154 may define a height ($h_{21}$) from the surface 172 to the end 158. The height ($h_{21}$) may define a minimum thickness region of the cam lobe 120 along the surface 172. By way of non-limiting example, the height ($h_{21}$) may be less than forty percent of the longitudinal extent, or width, ($w_2$) of the surface 172. The depth ($d_2$) of the second portion 156 may be greater than or equal to the height ($h_{21}$). The depth ($d_2$) may be less than the longitudinal extent, or width, ($w_2$) of the surface 172. The height ($h_{22}$) of the second portion 156 may continuously increase from the end 158 of the first portion 154 to the end 162 of the second portion 156. The height ($h_{22}$) may be greater than the height ($h_{21}$).

In the present non-limiting example, the surface 172 defines a curved profile along its lateral extent. The height ($h_{21}$) may be defined generally perpendicular to the surface 172. More specifically, and by way of non-limiting example, the height ($h_{21}$) at the end 158 and the depth ($d_2$) may be defined along a majority of the curved profile of the cam lobe 120 that extends radially outward from the base circle region.

As illustrated in FIG. 4, the valve lift mechanism 122 may include first and second longitudinal ends 166, 168 forming edges of the cam engagement surface 140. The first longitudinal end region 148 may be located longitudinally between the first and second longitudinal ends 166, 168 of the valve lift mechanism 122. The structure defined by the second portion 156 of the first sidewall 146 discussed above may generally reduce contact stress on the cam lobe 120.

What is claimed is:

1. A valve lift mechanism comprising:

a cam engagement surface adapted to engage a cam lobe of a camshaft at a first location, extending longitudinally relative to a rotational axis of the camshaft and defining first and second longitudinal end regions opposite one another; and a first sidewall fixed to the cam engagement surface and including a first portion extending from the cam engagement surface and a second portion extending continuously inward from an end of the first portion toward the second longitudinal end region, a continuous inward extent of the second portion being greater than or equal to a first height at the first location defined from the cam engagement surface to the end of the first portion.

2. The valve lift mechanism of claim 1, wherein a second height greater than the first height is defined from the end of the first portion to a location on the first sidewall where the continuous inward extent of the second portion is defined.

3. The valve lift mechanism of claim 1, wherein a height of the second portion is continuously increasing along the continuous inward extent thereof.

4. The valve lift mechanism of claim 1, wherein the first height is less than 40 percent of a longitudinal extent of the cam engagement surface.

5. The valve lift mechanism of claim 1, wherein the first height is defined perpendicular to the cam engagement surface at the first location.

6. The valve lift mechanism of claim 1, wherein the first height defines a minimum thickness region along the cam engagement surface.

7. The valve lift mechanism of claim 1, wherein the second portion extends from the first portion at an angle of between 10 degrees and 80 degrees relative to the cam engagement surface.

8. The valve lift mechanism of claim 1, wherein the first portion of the first sidewall is defined at a terminal end of the cam engagement surface.

9. The valve lift mechanism of claim 1, wherein the continuous inward extent of the second portion is less than one-half of a longitudinal extent of the cam engagement surface.

10. The valve lift mechanism of claim 1, wherein the valve lift mechanism forms a rocker arm including a first end adapted to be supported for pivotal displacement on an engine structure and a second end adapted to engage a valve member, the cam engagement surface forming a slider pad rotationally fixed relative to the first and second ends and including an arcuate surface extending in a direction from the first end to the second end and defining a peak aligned with the first and second portions of the first sidewall.

11. An engine assembly comprising:

an engine structure;

a camshaft rotationally supported on the engine structure, defining a longitudinally extending rotational axis and including a cam lobe; and a valve lift mechanism supported on the engine structure and defining a body including:

a longitudinally extending cam engagement surface engaged with the cam lobe at a first location and defining first and second longitudinal end regions opposite one another; and a first sidewall fixed to the cam engagement surface and including a first portion extending from the cam engagement surface and a second portion extending continuously inward from an end of the first portion toward the second longitudinal end region, a continuous inward extent of the second portion being greater than or equal to a first height at the first location defined from the cam engagement surface to the end of the first portion.

12. The engine assembly of claim 11, wherein a second height greater than the first height is defined from the end of the first portion to a location on the first sidewall where the continuous inward extent of the second portion is defined.

13. The engine assembly claim 11, wherein a height of the second portion is continuously increasing along the continuous inward extent thereof.

14. The engine assembly of claim 11, wherein the first height is less than 40 percent of a longitudinal extent of the cam engagement surface.

15. The engine assembly of claim 11, wherein the first height is defined perpendicular to the cam engagement surface at the first location.

16. The engine assembly of claim 11, wherein the first height defines a minimum thickness region along the cam engagement surface.

17. The engine assembly of claim 11, wherein the second portion extends from the first portion at an angle of between 10 degrees and 80 degrees relative to the cam engagement surface.

18. The engine assembly of claim 11, wherein the first portion of the first sidewall is located longitudinally between first and second longitudinal ends of the cam lobe.

19. The engine assembly of claim 11, wherein the continuous inward extent of the second portion is less than one-half of a longitudinal extent of the cam engagement surface.

20. The engine assembly of claim 11, wherein the valve lift mechanism forms a rocker arm including a first end supported for pivotal displacement on the engine structure and a second end engaged with a valve member, the cam engagement surface forming a slider pad rotationally fixed relative to the first and second ends and including an arcuate surface extending in a direction from the first end to the second end and defining a peak aligned with the first and second portions of the first sidewall.

* * * * *